US006910428B2

(12) United States Patent
Laflamme et al.

(10) Patent No.: US 6,910,428 B2
(45) Date of Patent: Jun. 28, 2005

(54) UNDERCAR ASSEMBLY FOR A RAILCAR

(75) Inventors: Martin Laflamme, St-Romuald (CA); André Banville, La Pocatière (CA)

(73) Assignee: Bombardier Transportation (Technology) Germany GmbH, Berlin (DE)

( * ) Notice: Subject to any disclaimer, the term of this patent is extended or adjusted under 35 U.S.C. 154(b) by 0 days.

(21) Appl. No.: 10/374,982

(22) Filed: Feb. 28, 2003

(65) Prior Publication Data

US 2003/0164112 A1 Sep. 4, 2003

Related U.S. Application Data

(60) Provisional application No. 60/361,058, filed on Mar. 1, 2002.

(51) Int. Cl.[7] ..... B61D 17/00

(52) U.S. Cl. ..... 105/413; 105/413

(58) Field of Search ..... 105/396, 397, 105/399, 404, 413, 414, 415, 416, 417, 418

(56) References Cited

U.S. PATENT DOCUMENTS 2,753,813 A * 7/1956 Esher ..... 105/172
3,774,554 A * 11/1973 O'Neill et al. ..... 105/413
4,645,258 A * 2/1987 Ohmura et al. ..... 296/204
4,794,032 A 12/1988 Fujii et al.
4,825,774 A 5/1989 Tani et al.
5,309,845 A 5/1994 Onishi
5,388,529 A * 2/1995 Tieberghien et al. ..... 105/397
6,216,604 B1 * 4/2001 Forbes et al. ..... 105/421

FOREIGN PATENT DOCUMENTS

DE 3823418 A1 1/1990

OTHER PUBLICATIONS

European Search Report EP 03 00 4505, Jun. 20, 2003.

* cited by examiner

*Primary Examiner*—S. Joseph Morano
*Assistant Examiner*—Robert J. McCarry, Jr.

(57) ABSTRACT

An undercar assembly for a railroad car. The undercar assembly has a structural member extending longitudinally between the longitudinal sides of the railroad car, where this structural member includes a pair of longitudinally extending beam elements transversely spaced apart from one another. At least one auxiliary equipment bay is defined between the longitudinally extending structural member and one of the longitudinal sides of the railroad car. The auxiliary equipment bay is capable to receive at least one auxiliary equipment, the structural member being operative to support at least in part the auxiliary equipment in the auxiliary equipment bay.

42 Claims, 4 Drawing Sheets

UNDERCAR ASSEMBLY FOR A RAILCAR

CROSS-REFERENCE TO RELATED APPLICATION

The above-referenced application is based on U.S. provisional patent application No. 60/361,058, filed Mar. 1, 2002.

FIELD OF THE INVENTION

The present invention relates to railcars in general and, in particular, to an undercar assembly for a railcar that features a longitudinal structural member for supporting auxiliary equipment, such as air compressors, electrical boxes, reservoirs, etc.

BACKGROUND OF THE INVENTION

It is well known that, on trains and other types of railroad vehicles, there is a limited amount of available space, and this space must be divided between space for transporting people and/or goods, and space for the machinery and equipment operating the vehicle. The more this available space is taken up by the machinery and equipment required to operate the railroad vehicle, the less space there is to fulfill the commercial objective of the railroad vehicle, be it the transportation of people or goods, among other possibilities.

In order to more efficiently use the available space on a railroad vehicle, the underside of railcars are routinely used to support and transport auxiliary equipment, such as reservoirs, air compressors and electrical equipment. The associated compressed air hoses and electrical cables, including both high and low power cables, that may run from one end of the railcar to the other, are routed through the railcar ducts.

Typically, the underside of a railcar, also referred to as the undercar, is provided with a plurality of transverse beams extending between the sides of the railcar. These transverse beams, also known as stiffeners, serve to support and reinforce the floor of the railcar. In existing undercar assemblies, auxiliary equipment is supported on the underside of the railcar by means of small beams that are connected to the stiffeners, the small beams extending longitudinally between the stiffeners at various different locations. Brackets are welded to these small beams for receiving and holding the auxiliary equipment.

Unfortunately, the existing undercar assemblies for supporting auxiliary equipment on the underside of railcars lack any form of standardization. Rather the existing assemblies are complicated and, as a result, heavy and quite expensive to manufacture, install and maintain. In particular, the existing assemblies do not adapt well to different equipment layouts and situations.

The background information provided above clearly indicates that there exists a need in the industry to provide an improved undercar assembly for railcars for overcoming one or more of the limitations set forth above.

SUMMARY OF THE INVENTION

According to one broad aspect, the invention provides an undercar assembly for a railroad car. The undercar assembly has a structural member extending longitudinally between the longitudinal sides of the railroad car, where this structural member includes a pair of longitudinally extending beam elements transversely spaced apart from one another. At least one auxiliary equipment bay is defined between the longitudinally extending structural member and one of the longitudinal sides of the railroad car. The auxiliary equipment bay is capable to receive at least one auxiliary equipment, the structural member being operative to support at least in part the auxiliary equipment in the auxiliary equipment bay.

Advantageously, the undercar assembly provides a standardized mounting system that can accept different types of auxiliary equipment. Each auxiliary equipment includes a standard set of support brackets, at least one of which is received and supported by the structural member of the undercar assembly such that the auxiliary equipment may be suspended in the auxiliary equipment bay.

In a non-limiting example of implementation, the undercar assembly includes a pair of longitudinally extending beam members, each beam member being adjacent to a respective longitudinal side of the railcar. The structural member, which extends along a major portion of the length of the railcar, is positioned between the longitudinal sides of the railcar and, with the beam members, defines two longitudinally extending auxiliary equipment bays. The structural member is located at midpoint between the beam members, such that the auxiliary equipment bays are of identical size. It is also possible to locate the structural member closer to one of the beam members, creating one equipment bay of larger dimensions that the other equipment bay. The structural member may also be positioned diagonally, such that the equipment bays vary in width along their length.

The structural member includes a pair of transversally spaced beam elements that are parallel to one another along the entire length of the structural member. This parallel relationship is not essential; the beam elements may be positioned such that at different longitudinal positions, the distance between the beam elements varies. Each beam element of the structural member includes a plurality of receiving surfaces for supporting auxiliary equipment in the respective auxiliary equipment bay. These receiving surfaces are spaced apart and located at specific longitudinal positions along each beam element. In one example, each receiving surface of the structural member is a platform that extends laterally from one of the beam elements into the respective auxiliary equipment bay. The platforms are fixedly attached to the beam elements, for example using mechanical fasteners or adhesives, or through welding, among other possibilities.

The beam elements of the structural member define therebetween a conduit for receiving transmission lines, such as electrical cables and fluid hoses, connected to the various auxiliary equipment mounted in the auxiliary equipment bays. In a specific example, this conduit includes a first section for receiving low power electrical cables and a second section for receiving higher power electrical cables.

The auxiliary equipment bays may hold different types of auxiliary equipment. Examples of such auxiliary equipment include air compressors, compressed air tanks, electrical/electronic equipment boxes, and air conditioning units, among many other possibilities. Each auxiliary equipment to be mounted in the auxiliary equipment bays, regardless of the type or size of the equipment, includes a bracket set. The bracket set is formed of primary and secondary support brackets, located on the auxiliary equipment in a substantially opposing relationship. These support brackets are common to all auxiliary equipment to be mounted on the underside of the railcar. Note however that the position of the support brackets on the auxiliary equipment may vary from one auxiliary equipment to another. The support brackets are firmly fastened to the auxiliary equipment by welding or by any suitable fasteners, such as bolts or screws, among others.

The structural member is operative to engage the primary support bracket of each auxiliary equipment for supporting and holding the auxiliary equipment in the auxiliary equipment bays. More specifically, each receiving surface of each beam element of the structural member is capable to engage and support a primary support bracket of an auxiliary equipment. The secondary support bracket of each auxiliary equipment is engaged and supported by a receiving surface located adjacent one of the longitudinal sides of the railcar, such that the auxiliary equipment is securely held in the respective auxiliary equipment bay. In one example, a platform attached to one of the beam members located along the sides of the railcar serves to support the secondary support bracket of an auxiliary equipment when mounted in the respective auxiliary equipment bay.

In a variant example of implementation, the undercar assembly does not include beam members. In this case, each auxiliary equipment bay is defined between the structural member and one of the longitudinal sides of the railcar. Accordingly, while the primary support bracket of each auxiliary equipment is supported by the structural member, the secondary support bracket may be attached directly to the floor of the railcar cabin, using any suitable fastener. Alternatively, platforms, or any other suitable mating bracket pieces, may be secured directly to the floor of the railcar cabin, adjacent each longitudinal side of the railcar, for receiving and supporting the secondary support brackets of the auxiliary equipment.

It will be appreciated that, in any example of implementation of the present invention, the bracket set of an auxiliary equipment may include more than two individual support brackets. More specifically, each auxiliary equipment may include two or more primary support brackets, for engagement and support by the structural member. Furthermore, each auxiliary equipment may include two or more secondary support brackets, for engagement and support by respective receiving surfaces located adjacent one of the longitudinal sides of the railcar or for attachment, direct or indirect, to the floor of the railcar cabin. It should also be noted that an auxiliary equipment may include a different number of primary support brackets than of secondary support brackets.

According to a further broad aspect, the invention is directed to a method for mounting auxiliary equipment to the underside of a railroad car.

According to another broad aspect, the invention provides a railcar having longitudinal sides and including an undercar assembly. The undercar assembly includes a structural member extending longitudinally between the longitudinal sides of the railcar, where this structural member includes a pair of longitudinally extending beam elements transversely spaced from one another. At least one auxiliary equipment bay is defined between the structural member and one of the longitudinal sides of the railcar. The auxiliary equipment bay is capable to receive at least one auxiliary equipment, where the structural member is operative to support at least in part the auxiliary equipment in the auxiliary equipment bay.

According to yet another broad aspect, the invention provides a railcar having longitudinal sides and including an undercar assembly. The undercar assembly includes a structural member extending longitudinally between the longitudinal sides of the railcar, where this structural member includes a pair of longitudinally extending beam elements transversely spaced from one another. At least one auxiliary equipment bay is defined between the structural member and one of the longitudinal sides of said railcar. First and second auxiliary equipment are mounted in the auxiliary equipment bay, the second auxiliary equipment being different from the first auxiliary equipment, where the structural member engages both the first and second auxiliary equipment for supporting at least in part both the first and second auxiliary equipment in the auxiliary equipment bay.

BRIEF DESCRIPTION OF THE DRAWINGS

A detailed description of examples of implementation of the present invention is provided hereinbelow with reference to the following drawings, in which.

Figure 1:
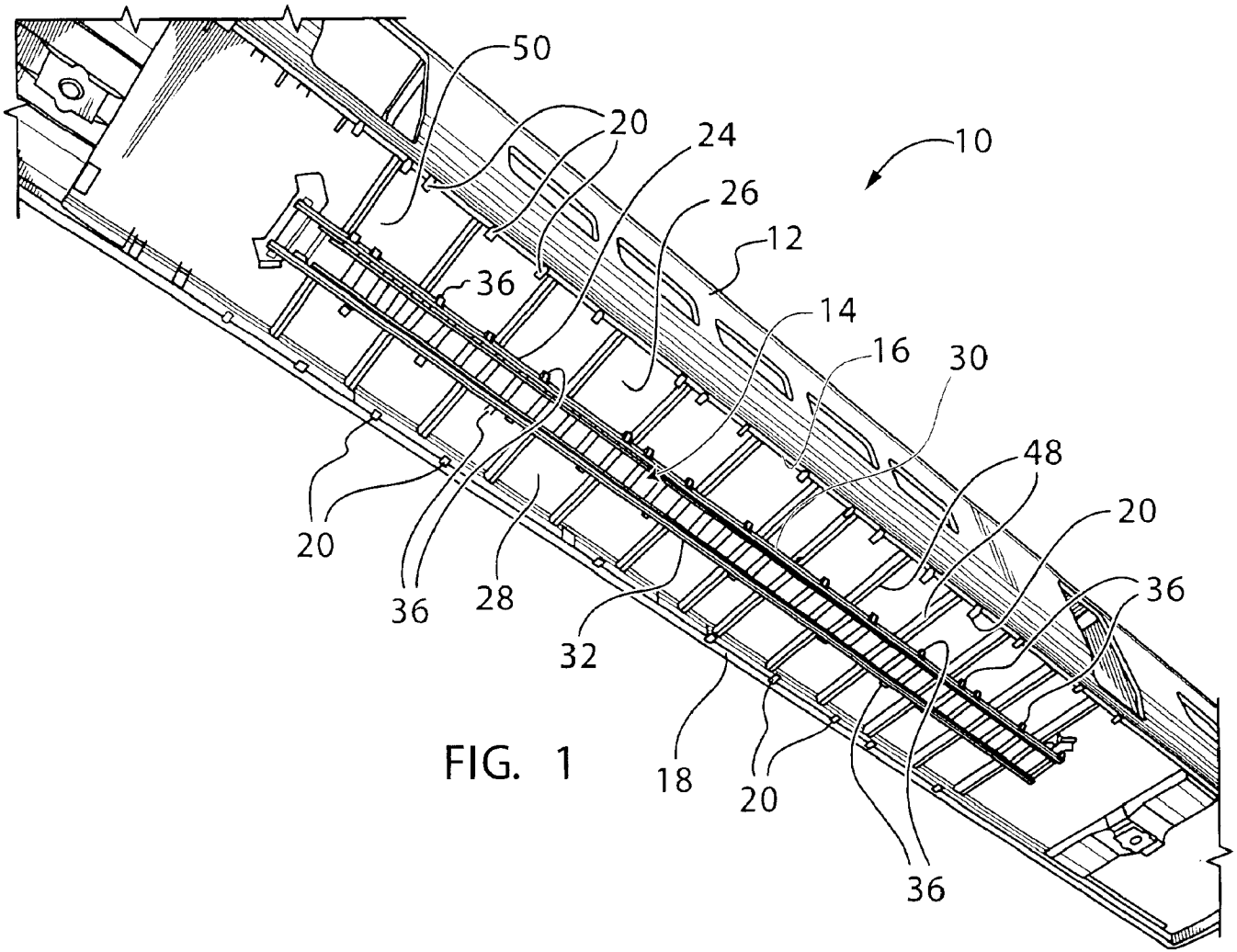
FIG. 1 is a perspective view of a railcar from the bottom, illustrating the undercar assembly prior to the installation of auxiliary equipment, according to a non-limiting example of implementation of the present invention.

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION

FIG. 1 is a perspective bottom view of a railcar, illustrating the undercar assembly according to a non-limiting example of implementation of the present invention. In FIG. 1, the railcar 10 is provided with a cabin 12 closed at the bottom by a floor 50, which is attached to the longitudinal sides of the cabin 12. The undercar assembly 14 includes a pair of longitudinally extending beam members 16 and 18, each beam member being adjacent to a respective longitudinal side of the railcar 10. Note that FIG. 1 depicts the undercar assembly 14 prior to the installation of any auxiliary equipment.

The railcar 10 includes a plurality of transverse members 48 that extend from the beam member 16 to the beam member 18, on the underside of the floor 50. The transverse members 48, also referred to as stiffeners, are longitudinally and equally spaced apart from one another, and serve to support and reinforce the floor 50 of the cabin 12.

Specific to the present invention, the undercar assembly 14 includes a structural member 24 that extends longitudinally along a major portion of the length of the railcar. The structural member 24, formed of a pair of transversally spaced beam elements 30, 32, is positioned between the longitudinal sides of the railcar 10 and, with the beam members 16, 18, defines two longitudinally extending auxiliary equipment bays 26, 28, respectively. Each auxiliary equipment bay 26, 28 is capable to receive auxiliary equipment, where the structural member 24 is operative to partly support the auxiliary equipment in the auxiliary equipment bays 26, 28, as will be described in further detail below.

The structural member 24 is attached to the stiffeners 48 of the railcar 10, as will be described in further detail below.

In the example shown in FIG. 1, the structural member 24 is located at midpoint between the beam members 16, 18, such that the auxiliary equipment bays 26, 28 are of identical size. It is also possible to locate the structural member 24 closer to one of the beam members 16, 18, creating one equipment bay of larger dimensions that the other equipment bay. The structural member 24 may also be positioned diagonally, such that the equipment bays 26, 28 vary in width along their length.

Figure 2:
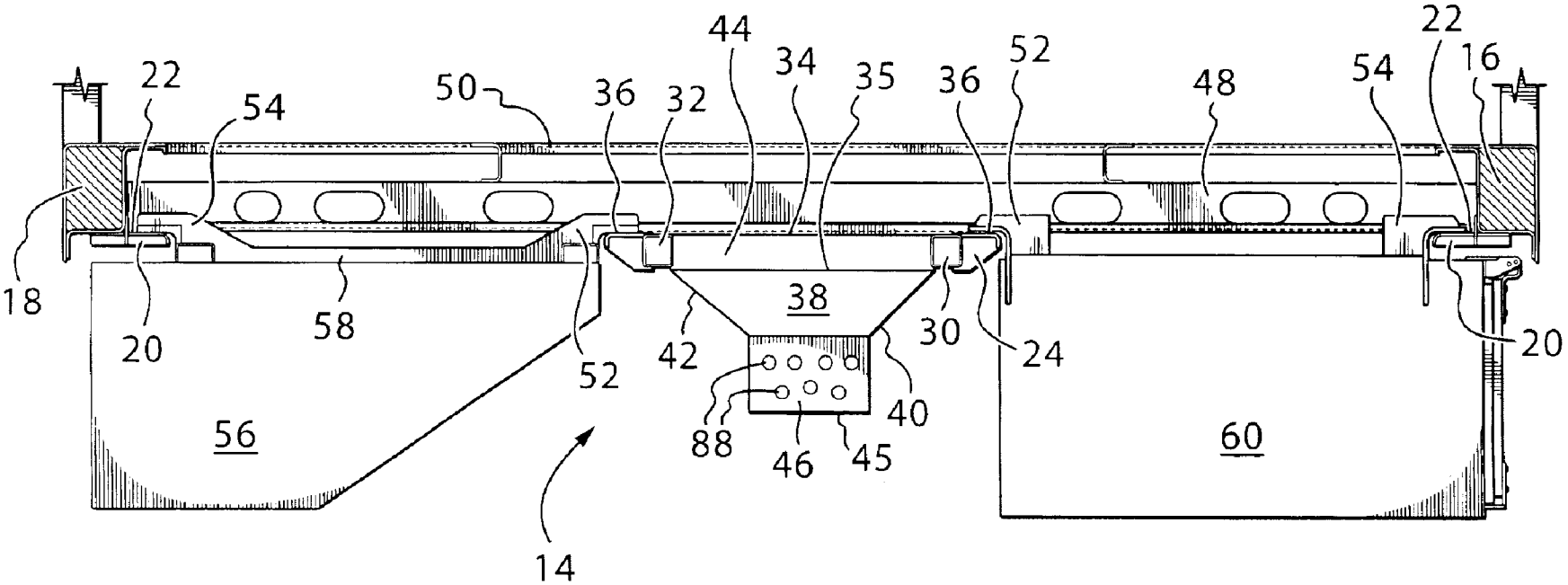
FIG. 2 is a cross-sectional view of the railcar undercar assembly shown in FIG. 1, after the installation of auxiliary equipment.

The structure of the structural member 24 is best shown at FIG. 2, which illustrates a cross-sectional view of the railcar floor 50, the stiffeners 48 and the undercar assembly 14 after the installation of auxiliary equipment 56, 60. The pair of transversally spaced beam elements 30, 32 of the structural member 24 are parallel to one another along the entire length of the structural member 24. This parallel relationship is not essential; the beam elements 30, 32 may be positioned such that at different longitudinal positions, the distance between the beam elements 30, 32 varies. The beam elements 30 and 32 are hollow and have a square cross section. Alternatively, the beam elements 30 and 32 can be solid and/or have different cross sections, examples of which include triangular, rectangular, polygonal, circular, U-shaped, L-shaped, I-shaped and C-shaped cross sections, among other possibilities. Moreover, the beam elements 30 and 32 may be formed integrally, e.g., as an I-beam.

Each beam element 30, 32 of the structural member 24 includes a plurality of receiving surfaces 36 for supporting auxiliary equipment in the respective auxiliary equipment bay 26, 28, as will be described in further detail below. These receiving surfaces 36 are spaced apart and located at specific longitudinal positions along each beam element 30, 32. In the example shown in FIG. 1, each receiving surface 36 of the structural member 24 is a platform that extends laterally from one of the beam elements 30, 32 into the respective auxiliary equipment bay 26, 28. The platforms 36 are fixedly attached to the beam elements 30, 32, for example with mechanical fasteners or adhesives, or through welding, among other possibilities.

Beam elements 30, 32 of the structural member 24 define therebetween a conduit 38 for receiving transmission lines, such as electrical cables and compressed air hoses. In the non-limiting example shown in FIG. 2, this conduit 38 includes first and second sections 44 and 46.

As shown in FIG. 2, on top of the beam elements 30 and 32 is attached a flat horizontal upper surface 34, while below is attached a flat horizontal lower surface 35. Upper and lower surfaces 34, 35 extend longitudinally along the length of the beam elements 30, 32, and are each formed of a series of plates. These plates are positioned adjacent one another such as to form continuous upper and lower surfaces 34, 35, and are attached to the beam elements 30, 32, for example with a fastener such as a bolt or a screw, among other possibilities. Together, the beam elements 30, 32 and upper and lower surfaces 34, 35 form the first section 44 (also referred to as upper compartment 44) of conduit 38. The upper compartment 44 is typically used to house low power electric cables.

Note that each plate of the upper and lower surfaces 34, 35 is detachable by unfastening the respective fastener(s), such that the cables housed within the upper compartment 44 may be accessed at different longitudinal positions of the upper compartment 44. In the example of FIG. 2, the plates of the upper and lower surfaces 34, 35 are made of metal; however, other suitable materials providing the requisite strength and rigidity may be substituted therefor.

Located below the upper compartment 44 are a plurality of cable support compartments 45, typically used to route high power electrical cables and hydraulic lines. The cable support compartments 45 are spaced apart longitudinally along the length of the structural member 24, and together define the second section 46 of the conduit 38. Each cable support compartment 45 is suspended from the upper compartment 44 by means of a respective pair of conduit brackets 40, 42, which project downwardly from the beam elements 30, 32, respectively.

Figure 4:
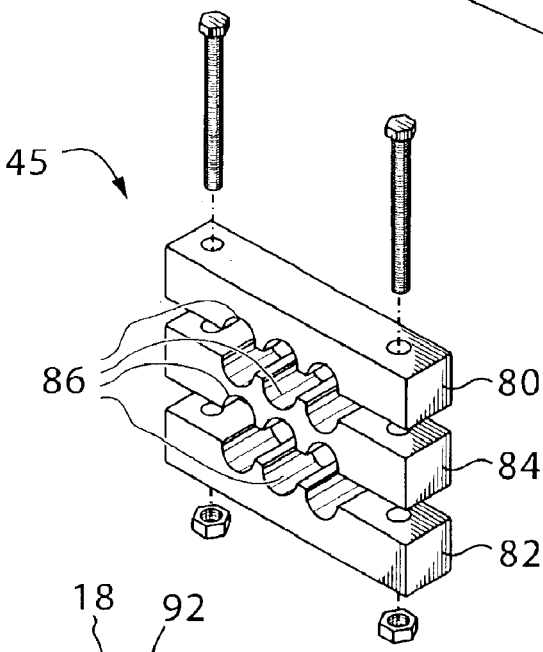
FIG. 4 is an exploded perspective view of an example of a cable support compartment of the structural member shown in FIG. 2.

With reference to the exploded view of FIG. 4, each cable support compartment 45 is formed of a top plate 80, a bottom plate 82 and a middle plate 84. Together, the plates 80, 82 and 84 are capable to hold cables therebetween. More specifically, the bottom and middle plates 82, 84 are operative to hold a first set of cables therebetween, while the middle and top plates 84, 80 are operative to hold a second set of cables therebetween. As seen in FIG. 4, each of the top, bottom and middle plates 80, 82, 84, respectively, define a plurality of recesses 86. In the case of the middle plate 84, the recesses 86 are defined on both top and bottom surfaces of the plate 84, such that, for each recess of the top and bottom plates 80, 82, there is provided a mating recess on the middle plate 84. Thus, in use, the cable support compartment 45 defines a plurality of cable-receiving channels 88, as seen in FIG. 2, for routing the high power electrical cables. The plates 80, 82 and 84 are attached together with any suitable fastener, such as a bolt or a screw, among other possibilities.

Note that a cable support compartment 45 may also be formed without the middle plate 84, since the top plate 80 and bottom plate 82, both defining recesses 86, would be sufficient to hold cables therebetween in cable-receiving channels 88. Alternatively, the cable support compartment 45 may be formed with two or more middle plates 84, for holding and routing additional sets of cables.

It is also important to note that, in variant examples of implementation, the upper compartment 44 and/or the cable support compartments 45 of the structural member 24 may be used to route different types of transmission lines. Such different types of transmission lines may include electrical cables, hydraulic lines, pneumatic lines, refrigerant lines for air conditioning, computer wiring, communication wiring and optical fibers, among many other possibilities.

Referring to FIG. 1, the beam members 16, 18 are affixed to the stiffeners 48 located on the underside of the floor 50 of the railcar 10. The beam members 16, 18 extend along substantially the entire length of the railcar 10, from one set of wheels at one end of the railcar 10 to the other set of wheels at the other end of the railcar 10. It will be plain to a person skilled in the art that this is not an essential requirement of the invention. As seen in FIG. 2, each beam member 16, 18 is a box section made of folded sheet metal to provide the requisite strength and rigidity. To each box section are secured receiving surfaces in the form of platforms 20. These platforms 20 project laterally inwardly and are located at specific longitudinal positions along the respective beam member 16, 18. The platforms 20 define an upper surface 22 to support brackets for carrying auxiliary equipment that will be described later.

Advantageously, the total load arising from a sudden stop or braking action by the railcar 10 is distributed over the full length of the structural member 24, as opposed to over the length of a plurality of small beams extending between the stiffeners 48, as in existing undercar assembly designs. This distribution of the load over the length of the structural member 24 prevents stress concentrations on the floor 50 caused by auxiliary equipment, typical of existing undercar assembly designs.

Figure 3:
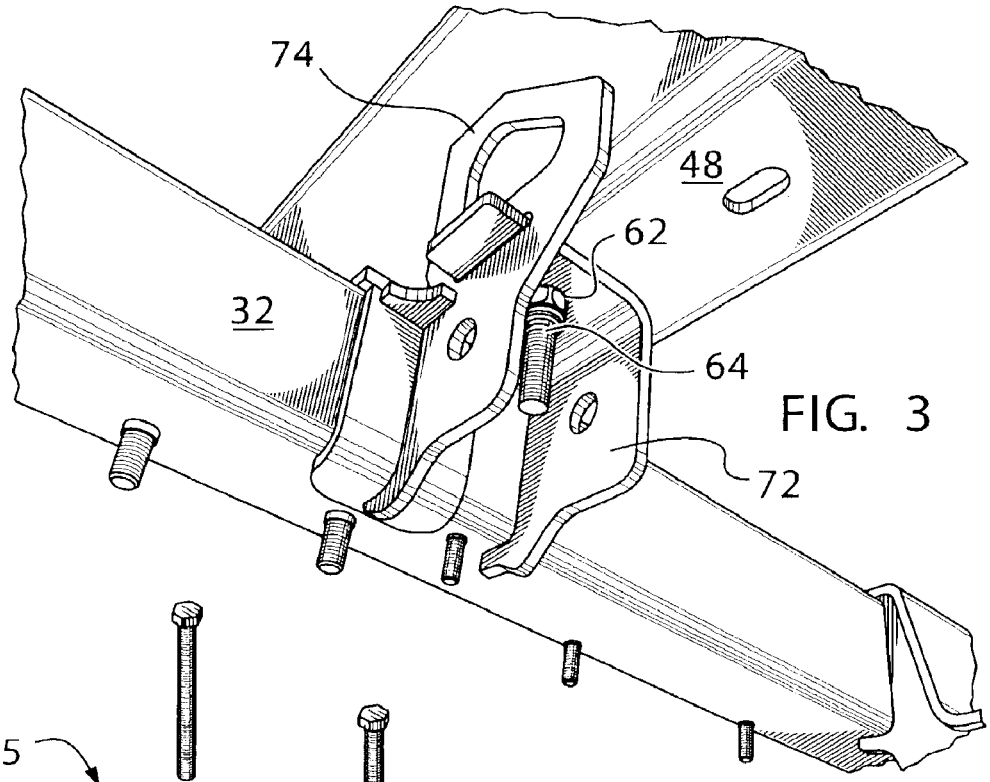
FIG. 3 is a simplified illustration of a bracket for supporting a structural member of the undercar assembly to a stiffener of the railcar, according to an example of implementation of the present invention.

The entire structural member 24 can be prefabricated. At the time of installing the structural member 24 to the underside of the railcar 10, the beam elements 30 and 32 may be affixed to the stiffeners 48 in any suitable way. By way of non-limiting example, FIG. 3 illustrates one particular manner of attaching a beam element, in this example beam element 32, to one of the stiffeners 48. Specifically, there is provided a mounting bracket 72 designed to slidingly engage the beam element 32.

When installing the structural member 24 to the underside of the railcar 10, the mounting bracket 72 is slid along the beam element 32 for varying the longitudinal position of the mounting bracket 72 on the beam element 32. The mounting bracket 72 may be fastened to the beam element 32 in a number of suitable ways known to those of ordinary skill in the art, including welding and/or using a fastener, such as a lug nut, among many other possibilities. The mounting bracket 72 has an upwardly protruding alignment plate 74 which can be used to align the beam element 32 in a predetermined angular orientation (e.g., perpendicular) with respect to the stiffener 48. The mounting bracket 72 also has an aperture 62 designed to receive a fastener, such as a rivet, a bolt or a lug nut, among other possibilities, to permanently fix the mounting bracket 72 to the stiffener 48. In the example shown in FIG. 3, the mounting bracket 72 is affixed to the stiffener 48 by a standard bolt 64. Additional support may also be provided by welding the mounting bracket 72 to the stiffener 48.

The auxiliary equipment bays 26 and 28 are provided to hold different types of auxiliary equipment. Examples of such auxiliary equipment include air compressors, compressed air tanks, electrical/electronic equipment boxes, and air conditioning units, among many other possibilities.

Each auxiliary equipment to be mounted in the auxiliary equipment bays 26, 28, regardless of the type or size of the equipment, includes a bracket set. The bracket set is formed of at least two support brackets, including a primary support bracket and a secondary support bracket, located on the auxiliary equipment in a substantially opposing relationship. In the example of FIG. 2, the primary and secondary support brackets are shown as support brackets 52 and 54, respectively. The primary and secondary support brackets are common to all auxiliary equipment to be mounted on the underside of railcar 10, and are each characterized by a standard size and shape. This standard size and shape may be common to both the primary and secondary support brackets. Alternatively, the secondary support brackets may be characterized by a standard size and shape that differs from the standard size and shape of the primary support brackets.

Note that the position of the primary and secondary support brackets on the auxiliary equipment may vary from one auxiliary equipment to another, in dependence of the size or shape of the auxiliary equipment.

The support brackets are firmly fastened to the auxiliary equipment by welding or by any suitable fasteners, such as bolts or screws, among others. Note that the primary and secondary support brackets of an auxiliary equipment may be connected by a link, as shown for auxiliary equipment 56 in the example of FIG. 2, where primary support bracket 52 is connected to secondary support bracket 54 by link 58. Alternatively, the primary and secondary support brackets of an auxiliary equipment may be distinct and separate from one another, as shown for auxiliary equipment 60, different from the auxiliary equipment 56 in terms of function and dimensions, in the example of FIG. 2.

The structural member 24 is operative to engage the primary support bracket of each auxiliary equipment, for supporting and holding the auxiliary equipment in the auxiliary equipment bays 26, 28. More specifically, each receiving surface 36 of each beam element 30, 32 of the structural member 24 is capable to engage and support the primary support bracket of an auxiliary equipment. The secondary support bracket of each auxiliary equipment is engaged and supported by a respective receiving surface located adjacent one of the longitudinal sides of the railcar 10, such that the auxiliary equipment is securely held in the respective auxiliary equipment bay 26, 28. In the example shown in FIGS. 1 and 2, a platform 20 attached to one of beam members 16, 18 serves to support the secondary support bracket of an auxiliary equipment when mounted in the respective auxiliary equipment bay 26, 28.

It will be appreciated that the bracket set of an auxiliary equipment may include more than two individual support brackets. More specifically, each auxiliary equipment may include two or more primary support brackets, for engagement and support by respective receiving surfaces 36 of the structural member 24. Furthermore, each auxiliary equipment may include two or more secondary support brackets, for engagement and support by respective receiving surfaces located adjacent one of the longitudinal sides of the railcar 10. It should also be noted that an auxiliary equipment may include a different number of primary support brackets than of secondary support brackets, in dependence of the shape and size of the auxiliary equipment.

Each receiving surface 20 on each beam member 16, 18 is associated with at least one receiving surface 36 on the corresponding beam element 30, 32 of the structural member 24, in order to properly engage an auxiliary equipment supported in the respective auxiliary equipment bay 26, 28. Furthermore, two or more different receiving surfaces 20 on beam member 16, 18 may be associated with the same receiving surface 36 on the corresponding beam element 30, 32, and vice versa. By "associated" is implied that a cooperative relationship exists between the receiving surfaces 20 and 36, in order to support a particular auxiliary equipment in the respective auxiliary equipment bay 26, 28.

Note that the associations between the receiving surfaces 20 on beam member 16, 18 and the receiving surfaces 36 on corresponding beam element 30, 32 are determined on the basis of the number of primary and secondary support brackets on each auxiliary equipment to be supported in the respective equipment bay 26, 28.

Also note that the longitudinal position of a particular receiving surface 20 on the beam member 16, 18 may match the longitudinal position of an associated receiving surface 36 on the corresponding beam element 30, 32. Alternatively, a particular receiving surface 20 on the beam member 16, 18 may be purposely offset from an associated receiving surface 36 on the corresponding beam element 30, 32. The longitudinal positions of the receiving surfaces 20 on the beam members 16, 18, as well as of the receiving surfaces 36 on the beam elements 30, 32, are determined on the basis of the position of the primary and secondary support brackets of the auxiliary equipment to be mounted in the auxiliary equipment bays 26,28.

In the example of implementation shown at FIG. 2, the auxiliary equipment 56 is suspended in the auxiliary equipment bay 28 by support brackets 52 and 54. The primary support bracket 52 rests on the upper surface of platform 36, attached to beam element 32 of the structural member 24. The secondary support bracket 54 rests on the upper surface 22 of platform 20, attached to beam member 18.

Figure 5:
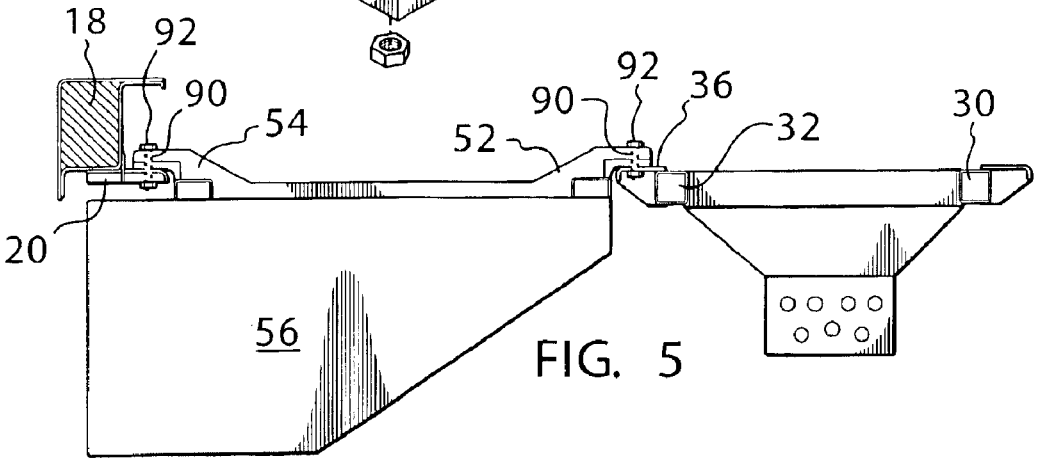
FIG. 5 is a simplified illustration of an example of the engagement of an auxiliary equipment support bracket by a receiving surface of the structural member shown in FIG. 2.

With reference to the example shown in FIG. 5, each receiving surface 36 of the structural member 24, as well as each receiving surface 20 of beam members 16, 18, may include a fastener receiving portion 90 for receiving any suitable fastener 92, such as a bolt or a screw, for retaining the respective support bracket of the auxiliary equipment to the receiving surface.

On the basis of the undercar assembly 14 described above, the method for installing an auxiliary equipment in an auxiliary equipment bay 26, 28 is simple and straightforward. Note however that this method presumes that a set of standard support brackets has already been attached to the auxiliary equipment. The method includes the step of positioning longitudinally and laterally the auxiliary equipment in the auxiliary equipment bay 26, 28 such that the primary and secondary support brackets of the auxiliary equipment are located next to their dedicated receiving surfaces 36, 20 on both the structural member 24 and the corresponding beam member 16, 18. The auxiliary equipment is then elevated such that the support brackets are free to slide on top of the dedicated receiving surfaces 36, 20. The auxiliary equipment is then slid longitudinally such that the primary and secondary support brackets are precisely aligned with the dedicated receiving surfaces 36, 20, respectively. Next, fasteners are installed to retain the primary and secondary support brackets of the auxiliary equipment to the structural member 24 and to one of the beam members 16, 18, respectively, thus locking the auxiliary equipment in place. Any cables, fluid hoses or other transmission lines extending from the installed auxiliary equipment are routed through the conduit 38, as described above.

Figure 6:
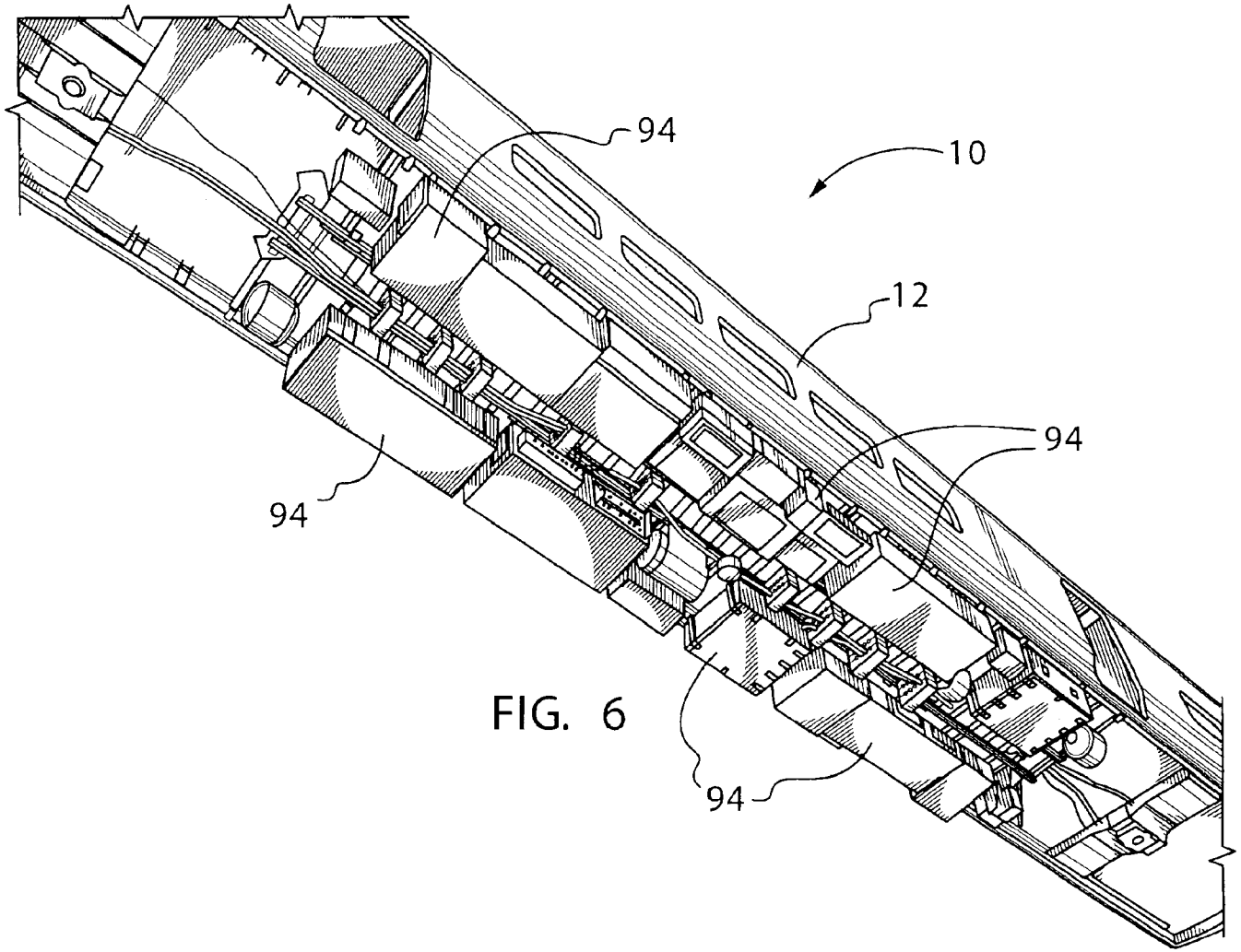
FIG. 6 is a bottom perspective view of the railcar shown in FIG. 1, with different types of auxiliary equipment mounted to the undercar assembly.

For purposes of clarification, FIG. 6 shows an example of the railcar 10 in which various different auxiliary equipment 94 have been installed to the undercar assembly 14. Thus, each auxiliary equipment 94 is suspended within one of the auxiliary equipment bays 26, 28 created by the beam elements 30, 32 of the structural member 24 and the beam members 16, 18.

In a variant example of implementation, the undercar assembly 14 does not include beam members 16 and 18. In this case, each auxiliary equipment bay 26, 28 is defined between the structural member 24 and one of the longitudinal sides of the railcar 10. Accordingly, the secondary support bracket(s) of each auxiliary equipment may be attached directly to the floor 50 of the cabin 12, using any suitable fastener. Alternatively, platforms 20, or any other suitable mating bracket pieces, may be secured directly to the floor 50, adjacent each longitudinal side of the railcar 10, for receiving and supporting the secondary support brackets of the auxiliary equipment. In another alternative, a plurality of small beams are attached to the floor 50 of the railcar 10 between the stiffeners 48. These beams are longitudinally spaced apart from each other, along each longitudinal side of the railcar 10. Attached to each beam is at least one platform 20 for receiving and supporting a secondary support bracket of an auxiliary equipment.

In yet another variant example of implementation, the railcar 10 does not include any stiffeners 48 on the underside of the floor 50. In this case, the structural member 24 is attached directly to the floor 50 of the cabin 12. More specifically, the beam elements 30, 32 of the structural member 24 are secured to the floor 50 of the cabin 12 using any suitable type of fastener, including mounting brackets and/or welding, among other possibilities. Similarly, if the undercar assembly 14 includes beam members 16, 18, the latter are also attached directly to the floor 50 of the cabin 12, using any suitable type of fastener.

Although various embodiments have been illustrated, this was for the purpose of describing, but not limiting, the invention. Various modifications will become apparent to those skilled in the art and are within the scope of this invention, which is defined more particularly by the appended claims.

What is claimed is:

1. An undercar assembly for a railroad car, the railroad car having longitudinal sides, said undercar assembly comprising:

a. a structural member extending longitudinally between the longitudinal sides of the railroad car, said structural member including a pair of longitudinally extending beam elements transversally spaced apart from one another;

b. at least one auxiliary equipment bay capable to receive at least one auxiliary equipment, said auxiliary equipment bay defined by said structural member and one of the longitudinal sides of the railroad car, wherein said structural member is operative to support at least in part the auxiliary equipment in said auxiliary equipment bay.

2. An undercar assembly as defined in claim 1, including a pair of longitudinally extending equipment bays, each equipment bay extending between said structural member and a respective longitudinal side of the rail car, each auxiliary equipment bay capable to receive at least one auxiliary equipment, wherein said structural member is operative to support at least in part each auxiliary equipment in said respective auxiliary equipment bay.

3. An undercar assembly as defined in claim 2, wherein each auxiliary equipment includes at least one primary support bracket and at least one secondary support bracket, said structural member being operative to engage the primary support bracket of each auxiliary equipment for supporting the auxiliary equipment in said respective auxiliary equipment bay.

4. An undercar assembly as defined in claim 3, wherein said structural member includes a plurality of receiving surfaces, each receiving surface operative to engage the primary support bracket of an auxiliary equipment for supporting the auxiliary equipment in said respective auxiliary equipment bay.

5. An undercar assembly as defined in claim 4, wherein a particular auxiliary equipment includes two or more primary support brackets, said structural member being operative to engage the two or more primary support brackets of the particular auxiliary equipment for supporting the particular auxiliary equipment in said respective auxiliary equipment bay.

6. An undercar assembly as defined in claim 5, wherein said structural member includes a receiving surface for each primary support bracket of the particular auxiliary equipment.

7. An undercar assembly as defined in claim 4, wherein said structural member extends along at least a major portion of the length of the railroad car.

8. An undercar assembly as defined in claim 7, wherein each auxiliary equipment bay extends between one of the beam elements of said structural member and a respective longitudinal side of the railcar.

9. An undercar assembly as defined in claim 8, wherein, for each beam element of said structural member, the receiving surfaces are located at specific longitudinal positions along the beam element.

10. An undercar assembly as defined in claim 9, wherein each receiving surface of said structural member is a platform extending transversely from one of said beam elements into the respective auxiliary equipment bay.

11. An undercar assembly as defined in claim 10, wherein each platform of said structural member is fixedly attached to the respective beam element.

12. An undercar assembly as defined in claim 11, wherein each platform of said structural member is welded to the respective beam element.

13. An undercar assembly as defined in claim 8, wherein said structural member defines a conduit for receiving transmission lines.

14. An undercar assembly as defined in claim 13, wherein said conduit includes first and second sections, each section operative to receive a respective set of transmission lines.

15. An undercar assembly as defined in claim 14, wherein the transmission lines are selected from the group consisting of electrical cables, hydraulic lines, pneumatic lines, refrigerant lines for air conditioning, computer wiring, communication wiring and optical fibers.

16. An undercar assembly as defined in claim 14, wherein said first section receives low power electrical cables and said second section receives higher power electrical cables.

17. An undercar assembly as defined in claim 14, wherein said conduit is defined between said longitudinally extending beam elements of said structural member.

18. An undercar assembly as defined in claim 17, wherein said structural member includes a longitudinally extending upper surface and a longitudinally extending lower surface, said upper and lower surfaces together with said beam elements defining said first section of said conduit.

19. An undercar assembly as defined in claim 18, wherein each of said upper and lower surfaces are formed of a series of adjacent plates, each plate being attached to said beam elements.

20. An undercar assembly as defined in claim 17, wherein said conduit includes a plurality of cable support compartments, said cable support compartments together defining said second section of said conduit.

21. An undercar assembly as defined in claim 20, wherein said structural member includes a plurality of conduit brackets projecting downwardly from said beam elements, each cable support compartment being suspended from said first section of said conduit by a pair of conduit brackets.

22. An undercar assembly as defined in claim 21, wherein each cable support compartment includes a bottom plate and a top plate, whereby said bottom and top plates are operative to hold cables therebetween.

23. An undercar assembly as defined in claim 22, wherein each cable support compartment further includes at least one middle plate, whereby said bottom and middle plates are operative to hold a first set of cables therebetween, and said middle and top plates are operative to hold a second set of cables therebetween.

24. An undercar assembly as defined in claim 23, wherein each of the top, middle and bottom plates of said cable support compartment includes a plurality of recesses, whereby said middle plate defines a plurality of cable-receiving channels with each of said top and bottom plates.

25. An undercar assembly as defined in claim 10, further comprising a pair of longitudinally extending beam members, each beam member being located adjacent a respective longitudinal side of the rail car.

26. An undercar assembly as defined in claim 25, wherein each auxiliary equipment bay extends between one of the beam elements of said longitudinally extending structural member and a respective one of said beam members.

27. An undercar assembly as defined in claim 26, wherein each particular beam member is operative to engage the secondary support bracket of each auxiliary equipment supported in the respective auxiliary equipment bay extending between said particular beam member and the respective beam element of said structural member.

28. An undercar assembly as defined in claim 27, wherein each beam member of said undercar assembly includes a plurality of receiving surfaces, each receiving surface operative to engage the secondary support bracket of an auxiliary equipment for supporting the auxiliary equipment in said respective auxiliary equipment bay.

29. An undercar assembly as defined in claim 28, wherein a particular auxiliary equipment includes two or more secondary support brackets, said respective beam member being operative to engage the two or more secondary support brackets of the particular auxiliary equipment for supporting the particular auxiliary equipment in said respective auxiliary equipment bay.

30. An undercar assembly as defined in claim 29, wherein said respective beam member includes a receiving surface for each secondary support bracket of the particular auxiliary equipment.

31. An undercar assembly as defined in claim 28, wherein, for each beam member, the receiving surfaces are located at specific longitudinal positions along the beam member.

32. An undercar assembly as defined in claim 31, wherein each receiving surface on each beam member has one or more associated receiving surfaces on the corresponding beam element of said structural member.

33. An undercar assembly as defined in claim 32, wherein each receiving surface of said structural member, and each receiving surface of each beam member, includes at least one fastener receiving portion, said fastener receiving portion suitable to receive a fastener for retaining the respective support bracket of the auxiliary equipment to the receiving surface.

34. An undercar assembly as defined in claim 33, wherein each receiving surface of a particular beam member is a platform extending transversely from the particular beam member into the respective auxiliary equipment bay.

35. A method for mounting auxiliary equipment to the underside of a railroad car, the railroad car having longitudinal sides, said method comprising:

a. providing a structural member extending longitudinally between the longitudinal sides of the railroad car, said structural member including a pair of longitudinally extending beam elements transversally spaced apart from one another, said structural member defining at least one auxiliary equipment bay with one of the longitudinal sides of the railroad car;

b. mounting at least one auxiliary equipment to said structural member for supporting at least in part the auxiliary equipment in said auxiliary equipment bay.

36. A railcar comprising:

a. a pair of longitudinal sides;

b. an undercar assembly including:

i. a structural member extending longitudinally between said longitudinal sides of said railcar, said structural member including a pair of longitudinally extending beam elements transversally spaced apart from one another;

ii. at least one auxiliary equipment bay capable to receive at least one auxiliary equipment, said auxiliary equipment bay defined by said structural member and one of said longitudinal sides of said railcar, wherein said structural member is operative to support at least in part the auxiliary equipment in said auxiliary equipment bay.

37. A railcar as defined in claim 36, said railcar including a floor and a plurality of transverse members mounted to the underside of said floor, said transverse members being longitudinally spaced apart from one another and extending between said longitudinal sides of said railcar.

38. A railcar as defined in claim 37, wherein said longitudinally extending structural member is mounted to said transverse members.

39. A railcar as defined in claim 38, wherein said undercar assembly further includes a plurality of mounting brackets attaching said structural member to said transverse members.

40. A railcar as defined in claim 39, wherein each mounting bracket engages one of the beam elements of said structural member for attaching the beam element to one of said transverse members, each mounting bracket being slideable on the respective beam element for varying the position of the mounting bracket on the respective beam element.

41. A railcar as defined in claim 40, wherein said transverse members are stiffeners.

42. A railcar, comprising:

a. a pair of longitudinal sides;

b. an undercar assembly including:

i. a structural member extending longitudinally between said longitudinal sides of said railcar, said structural member including a pair of longitudinally extending beam elements transversally spaced apart from one another;

ii. at least one auxiliary equipment bay defined by said structural member and one of said longitudinal sides of said railcar;

iii. a first auxiliary equipment mounted in said auxiliary equipment bay;

iv. a second auxiliary equipment, different from said first auxiliary equipment, mounted in said auxiliary equipment bay, whereby said structural member engages both said first and second auxiliary equipment for supporting at least in part both said first and second auxiliary equipment in said auxiliary equipment bay.

* * * * *